United States Patent [19]

Hannah

[11] 4,223,383

[45] Sep. 16, 1980

[54] ELECTRONIC CONTROL DEVICE FOR DECISIONS AND SCORING

[76] Inventor: James T. Hannah, 1 Cooinda Ct., Salisbury Heights, South Australia, Australia

[21] Appl. No.: 949,620

[22] Filed: Oct. 10, 1978

[30] Foreign Application Priority Data

Nov. 18, 1977 [AU] Australia ..... PD2461

[51] Int. Cl.[2] ..... G06F 15/44; G08B 23/00

[52] U.S. Cl. ..... 364/411; 235/92 GA; 340/323 R

[58] Field of Search ..... 364/411; 235/92 GA; 273/1 E, 1 ES; 340/323 R

[56] References Cited

U.S. PATENT DOCUMENTS

| | | | |
|---|---|---|---|
| 3,737,889 | 6/1973 | Sweeny | 235/92 GA X |
| 3,959,640 | 5/1976 | Syria | 364/411 |
| 4,097,855 | 6/1978 | Salvo | 235/92 GA X |

*Primary Examiner*—Jerry Smith

*Attorney, Agent, or Firm*—Pearne, Gordon, Sessions

[57] ABSTRACT

An electronic control device for decisions and scoring comprising at least three control boxes having scoring designations and coupled to an indicator panel through circuitry which displays the score of at least any two of the control boxes, used for squash and similar games.

7 Claims, 3 Drawing Figures

ELECTRONIC CONTROL DEVICE FOR DECISIONS AND SCORING

BACKGROUND OF INVENTION

This invention relates to an electronic device for scoring and in particular it relates to a device designed to take uncertainty out of decisions in the game of squash but it will be realised that the invention is applicable also with some modification to tennis and other games.

One of the reasons for the device is that world tournaments are being conducted which have extremely high prize money and therefore need a system of scoring which will ensure that the players can depend on the decision which is called, and while, for instance, the rules of squash as approved by the International Squash Racquet Federation allows for the control of the game by one referee and one marker, it is proposed according to the present invention that control be by one marker and by three referees, that is, by an odd number of persons, so that a decision recorded is the result of, for instance, two out of three decisions.

OBJECT OF THE INVENTION

It will be realised there, that the object of the invention is to ensure during scoring that the decision of more than one person will be available and the final decision will be a majority decision and the object of the invention therefore is to provide a device which will allow this to be effectively achieved.

SUMMARY OF INVENTION

Thus according to this invention a device is provided which has at least three decision units and one read out unit, the decision units each being provided with the necessary press buttons by means of which a decision can be recorded, and the read out unit being provided with indicators, such as lights, which show the result of all or any two of the decision units.

Thus in relation to the game of squash the three decision units could have seven buttons each, a central button recording a point, two buttons recording either a let or not let, two buttons scoring either up or not up, and two buttons scoring either in or out.

Each of these decision units can be held by persons at different vantage points and each of these units is coupled electrically to an electronic device which records only that decision which is given by two or the three persons, one of whom can be the referee.

Thus the referee for the game can as well as acting in a normal manner to call the decision be reinforced by two persons who simultaneously also record the decision as they see it, and as the device will then indicate the score recorded by all or at least two of these persons, a highly effective check is given on the referee's decision thus greatly reducing errors which could occur when a single referee is used.

While the decision units can have a series of buttons as described, it will be realised that this will vary according to the game to which the invention is applied but the basic principle is that at least three persons record their vote but the final decision is the result of any two of the three parties.

The read out unit can conveniently be arranged to show the recording of a point at the centre of a display ball with positive indicators to one side and negative indicators to the other side so that in the case of squash the UP, IN, and LET, would be on one side of the STROKE indicator, while the NO LET, OUT, and NOT UP would be on the other side.

DESCRIPTION OF PREFERRED EMBODIMENTS

This system illustrated is orientated in particular to the game of squash. It enables the rulings of three persons, which may be referees and two other persons, to be summed, and an indication of their majority ruling is displayed on a small panel attached to a markers' scoreboard. In the case of no decision i.e. a three way adjudication, a LET is indicated. The decision is reached with no one person being aware of another's decision, and thus constitutes a "silent vote".

The system entails each of the three persons having a small control box, marked respectively 1, 2 and 3, each with seven push button switches, 4, 5, 6, 7, 8, 9 and 10 marked—STROKE,LET, NO LET, UP, NOT UP, IN and OUT respectively.

Each of the three control boxes 1, 2 and 3 are connected to the electronic circuitry of an indicator panel 12 which may form part of the markers' scoreboard, the control boxes 1, 2 and 3 being connected to the summing electronics of the indicator panel 12 by cables 13.

Figure 1:
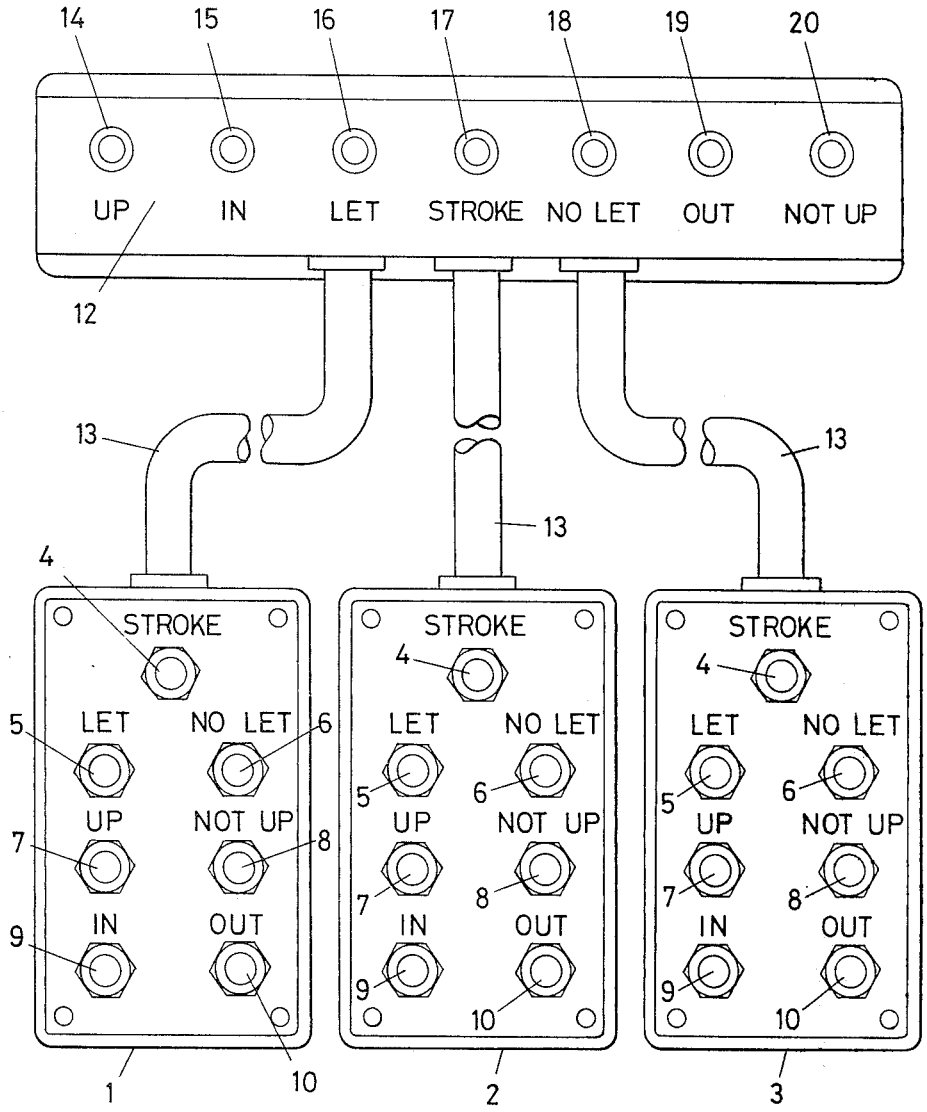
FIG. 1 is a schematic view showing a read out unit and three scoring units which connect thereto.
Figure 2:
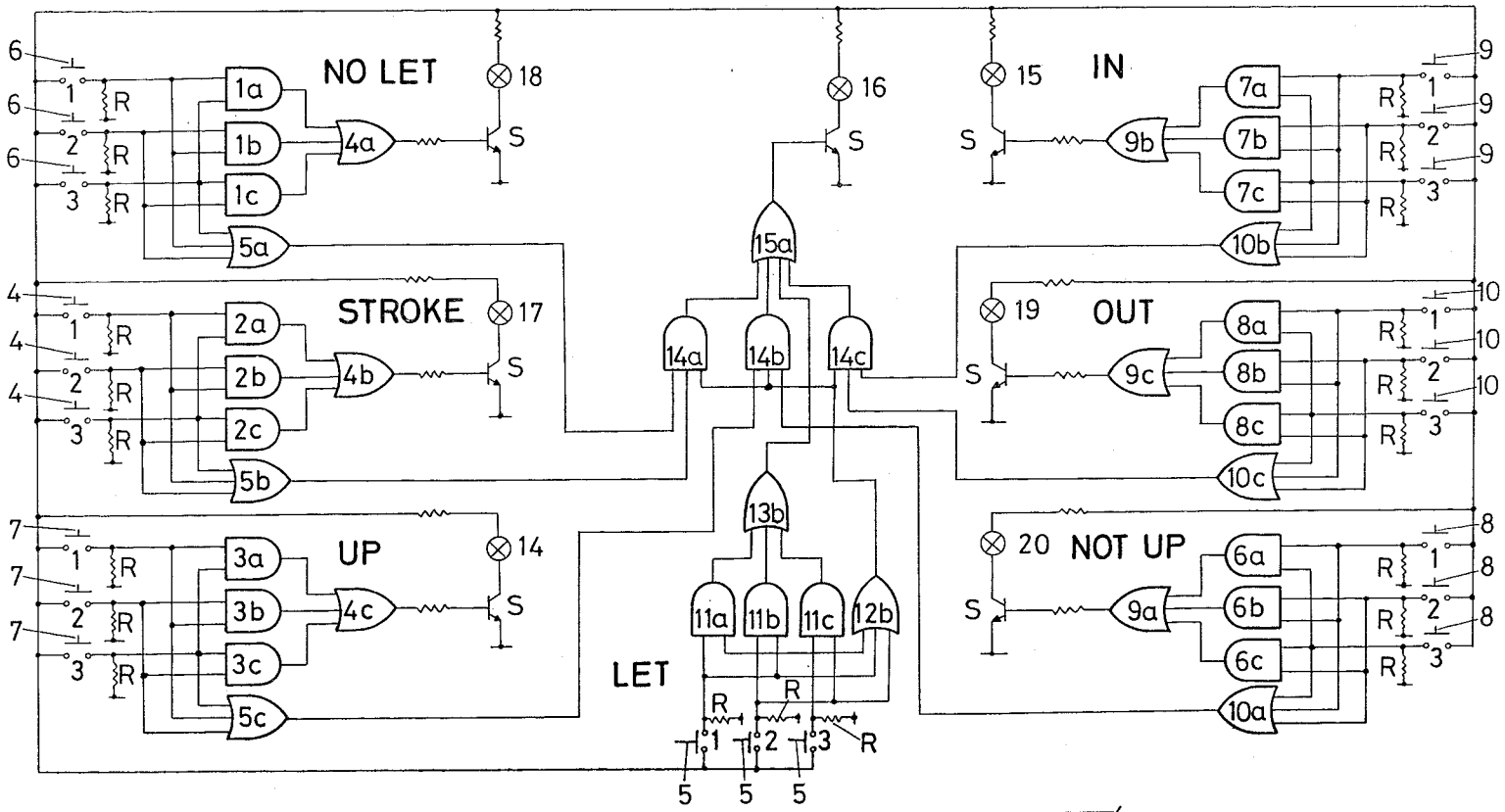
FIG. 2 is a schematic circuit diagram of a unit without a "hold" mechanism.

In the form described in FIG. 2, which does not have a "hold" circuit, the electronic circuitry is arranged so that if two or three persons make the same decision—that decision is indicated on the indicator panel 12 for as long as any two of the switches 4 to 10 are pressed. The circuit is so arranged that, in the case of no decision, a let is indicated. In the case of a person being unable to reach a decision, or through being unsighted, the LET button will be pressed by him.

Figure 3:
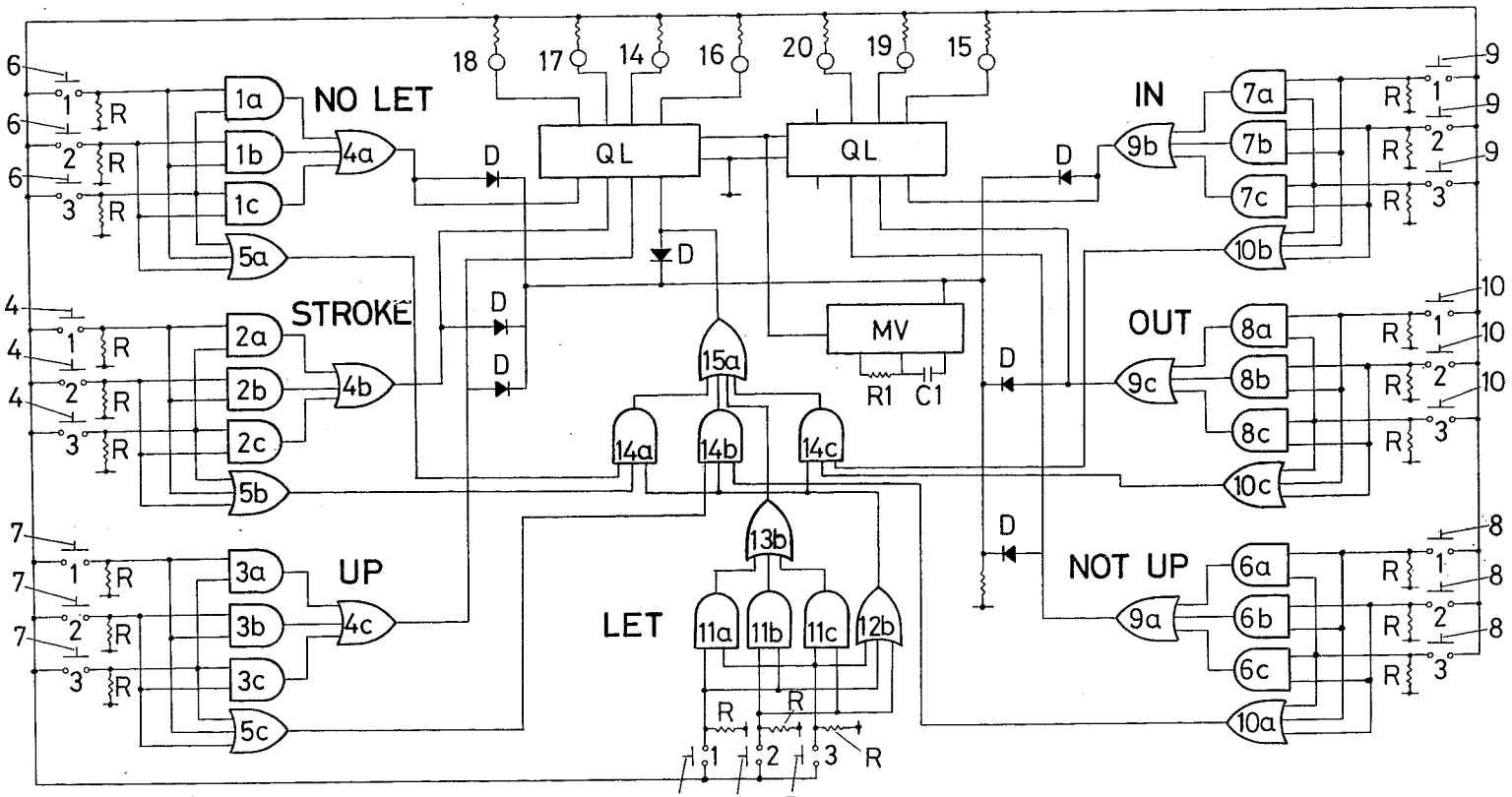
FIG. 3 is a similar view but including a "hold" circuit which can latch in and display the result for a short period after the buttons on the scoring unit are released.

The electronic circuitry consists of CMOS microcircuits switching LED indicators 14, 15, 16, 17, 18, 19 and 20 via switching transistors S, the circuits being shown in FIGS. 2 and 3.

The power supply may consist of dry cells, or any suitable power source.

The electronics and batteries may be fitted into a case for ready portability, and this can also hold the indicator panel. The markers display and scoreboard may pack into a pouch in the lid of the case, and the case can also removably carry the three control boxes.

The electronic circuitry will be first described with reference to FIG. 2 in which the appropriate indicator lights 14 to 20 are energised only when, and so long as, at least two similarly defined push buttons 4 to 10 are held down, that is, for instance the UP push buttons 7 in boxes 1 and 2 or 1 and 3 or 2 and 3, signifying that at least two persons are in agreement.

To enable the electrical circuits to be simply rendered, the numerals 1, 2 and 3 at the recording switches represent the boxes, but the AND gates controlled thereby are indicated by the letters, a, b and c with the numeral prefixes 1, 2, 3, 6, 7, 8 and 11, which represent respectively, NO LET, STROKE, UP, NOT UP, OUT, IN and LET.

The OR gates are again designated by the letters a, b and c but with the prefixes 4, 5, 9, 10, 12, 13, 14 and 15.

All gate inputs are held down by resistors R to $O_v$, and that the making of any switch to the positive line puts a logic 1 on the associated gate input.

NO LET 1, 2 and 3 switches are respective switches on the three control boxes. A combination of any two of these switches being made will result in one of the two input AND gates 1*a*, 1*b* or 1*c* putting a logic 1 on one input of the OR gate 4*a* thus switching on the transistor S associated with that gate and lighting the NO LET indicator light 18.

Similar circuits are associated with the STROKE, UP, NOT UP, IN, OUT and LET switches—except that the LET circuit includes additional OR gate 15*a* fed by the OR gates 5*a*, 5*b*, 5*c*, 10*a*, 10*b*, 10*c*, operating through the AND gates 14*a*, 14*b* and 14*c*. The NO LET circuit will be opened by any one switch being made.

It will be seen from the circuits of FIG. 2 that the OR gates 5*a*, 5*b* and 12*b* associated with NO LET, STROKE and LET switches are associated will put logic 1 on one input of the AND gate 14*a*, as will also any one STROKE or any one LET switch. Thus if one NO LET, one STROKE and one LET switch are pressed together this will put logic "1" on an input of the OR gate 15*a* and light the LET indicator 16.

Similar action will result with the combination of one LET, one NOT UP and one UP switch via 14*b*, or with the combination of one IN, one OUT and one LET switch via 14*c*.

Thus it will be seen that there is a primary circuit and a secondary circuit for each indicator, the primary circuit being controlled by the three similar push buttons in each of the control boxes 1, 2 and 3 which circuit comprises, for instance, the NO LET three AND gates 1*a*, 1*b* and 1*c*, to each of which two push buttons are connected, and these are summed by the OR gates 4*a* which then controls the switching transistor S to actuate the light 18 when at least two buttons actuate the AND gates.

The secondary circuit to the OR gate 5*a* receives a signal from each of the push buttons and is connected through the LET circuit AND gate 14*a* and through the OR gate 15*a* to the switching transistor S to the light 16, signals from the OR gates 5*b*, 5*c*, 10*a*, 10*b*, 10*c* and 12*b* similarly feeding through the AND gates 14*a*, 14*b*, 14*c* and the summation of these through the OR gate 15*a*.

A further refinement of the basic Refereering set is a facility to latch the outputs to the marker's display for a period of N seconds. Such an addition is shown in FIG. 3 which has the same references as FIG. 2.

The circuit remains the same as far as the summing inputs (two out of three) are concerned, but the outputs of 4*a*, 4*b* and 4*c*, 15*a* and 9*a*, 9*b*, and 9*c* are connected via diodes D to the input of a monostable multivibrator M.V. and also go directly via individual latches of the two Quad-latches QL. The monostable M.S. has a period of perhaps five seconds.

Upon any one decision being made, the monostable will go to "1" and the output will also go positive for N seconds determined by the time constant of the resistor R1 and condenser C1.

A further facility if required, is for the decision lines to be taken to a scoreboard for spectator presentation.

Generally it is not advisable to latch in the seven individual decisions but the facility can be used if required.

Variations in the mechanism will of course be made according to the game to which the scoring device is applied but the general principle will remain that, instead of there being a single referee, at least three persons will be used and any two which indicate a similar decision will actuate the read out unit so that in all cases the decision will not be the decision of a single person, but the majority decision will be indicated.

The device will also be found to be useful in televised coverage of sport where the decision of an umpire or referee can be shown in many cases to be wrong because the television cameras recorded the actual play sometimes from a better vantage point than the referee or umpire has and when a device according to this invention is in use, the advantage will exist not only that it is a majority decision which is being recorded, which itself will greatly reduce error, but the decision also is recorded on different vantage points as the main referee or umpire may have his usual position in relation to the game but the two other persons can be in advantageous positions where they can better interpret the decision with certain strokes and angles.

I claim:

1. An electronic control device for decisions and scoring comprising at least three control boxes, each control box having designated decision members each switchable between two logic states by a person to indicate a decision or score, an indicator panel having energisable indicator means designated to correspond to the said decision members and remote from the said control boxes, and electronic digital logic circuitry between the said decision members in the said control boxes and the energisable indicator means in the said indicator panel, said digital logic circuitry being arranged to actuate the said indicator means when similarly designated decision members situated in at least two separate control boxes are actuated to establish a predetermined logic pattern whereby the indicator means indicates the logic pattern of such actuated decision members.

2. An electronic control device according to claim 1, including AND gate means, OR gate means, and switching transistor means, wherein the similarly designated decision members of each control box are connected to a similar number of AND gates, each decision member being connected to two of said AND gates, said AND gates in turn being connected to a summing OR gate connected to a switching transistor which controls the similarly designated indicator means on the indicator panel to record a decision.

3. An electronic control device according to claim 2 wherein each of the said decision members are also connected to another OR gate to provide a signal to a specifically designated indicator light to energise same when less than the number of decision members required to energise the said AND gates to record a decision are actuated.

4. An electronic control device for scoring in a game wherein a referee or umpire is assisted by two further persons, comprising three boxes, one to be used by the referee or umpire and the others one each by the further persons, each said box having similar decision members each switchable between two logic states by the said referee or umpire and the said persons, said decision members being designated to represent the scores required, an indicator panel having energisable indicators designated to correspond to the said decision members, and electronic digital logic circuitry between the decision members and the said indicators arranged in duplicated groups one for each of the said designated scoring decisions whereby a majority decision is represented by a predetermined logic pattern established by actuation of three similar decision members, said circuitry actuating the indicator corresponding to the majority decision represented by said predetermined logic pattern, the said decision members of each group being also connected to pass a signal through a further digital logic circuit arranged so that when there is no majority decision a particular indicator is energised.

5. An electronic control device for scoring in the game of squash wherein a referee is assisted by two further persons, comprising three boxes, one to be used by the marker or referee and the others one each by the further persons, each said box having seven decision members each switchable between two logic states by the said persons, said decision members being designated to represent STROKE, NO LET, LET, NOT UP, UP, IN, and OUT, an indicator panel having energisable indicators designated to correspond to the said decision members, and electronic digital logic circuitry between the decision members and the said indicators arranged in duplicated groups one for each of the said designated scoring decisions whereby a majority decision is represented by a predetermined logic pattern established by actuation of three similar decision members, each said group including AND gates connected to an OR gate to sum the scores of the three decision members and actuate the indicator corresponding to the majority decision, the said decision members of each group being also connected to another OR gate connected to further AND gates arranged to pass a signal through a summing OR gate to the LET indicator, whereby when there is no majority decision a LET will be indicated.

6. An electronic control device according to claim 5 wherein the said decision members are push button switches connected by transmission cables to the electronic circuitry.

7. An electronic control device according to claims 3 or 5, including a hold circuit comprising electronic latches interposed between the said indicators and said OR gates which are connected to the AND gates of each said group, said OR gates being also connected through diodes to a monostable multivibrator in turn connected to said electronic latches.

* * * * *